US007712151B2

(12) United States Patent
Germain et al.

(10) Patent No.: US 7,712,151 B2
(45) Date of Patent: May 11, 2010

(54) INFLATABLE PROTECTIVE ENCLOSURE

(75) Inventors: Craig D. Germain, Ponce Inlet, FL (US); Lynie J. Germain, Ponce Inlet, FL (US)

(73) Assignee: Campus Housing Company LLC, Bluffton, SC (US)

( * ) Notice: Subject to any disclaimer, the term of this patent is extended or adjusted under 35 U.S.C. 154(b) by 1589 days.

(21) Appl. No.: 10/927,064

(22) Filed: Aug. 27, 2004

(65) Prior Publication Data

US 2006/0041994 A1 Mar. 2, 2006

(51) Int. Cl.
*A41D 13/00* (2006.01)

(52) U.S. Cl. ..... 2/69

(58) Field of Classification Search ..... 2/69, 2/227, 46, 455, 79, 92, 228, 51, 456, 267, 2/66, 22, 91, 465–467, DIG. 3
See application file for complete search history.

(56) References Cited

U.S. PATENT DOCUMENTS 3,911,913 A * 10/1975 June ..... 128/201.29
4,103,369 A 8/1978 Riordan
4,172,454 A * 10/1979 Warncke et al. ..... 128/201.29
4,202,676 A * 5/1980 Pelosi et al. ..... 96/416
4,384,435 A 5/1983 Polise et al.
4,552,140 A 11/1985 Cowley et al.
4,870,959 A 10/1989 Reisman et al.
4,950,222 A * 8/1990 Scott et al. ..... 600/21
4,977,623 A 12/1990 DeMarco
5,007,421 A 4/1991 Stewart
5,027,810 A 7/1991 Patureau et al.
5,206,958 A 5/1993 Widenback
5,315,987 A 5/1994 Swann
5,316,541 A * 5/1994 Fischer ..... 600/21
H1360 H 10/1994 Grove et al.
5,372,130 A 12/1994 Stern et al.
5,495,847 A 3/1996 Hu
5,529,058 A 6/1996 Crippen
5,537,784 A 7/1996 Baldwin
5,630,296 A 5/1997 Kendall, Jr.
5,690,095 A 11/1997 Glynn et al.
5,724,958 A 3/1998 Farnworth et al.
6,158,429 A 12/2000 Gardner et al.
6,340,024 B1 1/2002 Brookman et al.
6,450,165 B1 9/2002 Silver et al.
6,461,290 B1 10/2002 Reichman et al.
6,508,850 B1 * 1/2003 Kotliar ..... 55/385.2
6,516,536 B2 * 2/2003 Ryden ..... 34/106

(Continued)

*Primary Examiner*—Tejash Patel
(74) *Attorney, Agent, or Firm*—Oliff & Berridge, PLC

(57) ABSTRACT

An apparatus and method allows for the construction of an inflatable, protective enclosure that provides a temporary, contaminant free environment for one or more individuals. The approach results in a protective suit and/or enclosure that is inexpensive, compactly stored and light-weight, yet provides a reliable source of filtered, contaminant-free air as well as upper-body and/or full-body protection for one or more persons. The protective suits/enclosures described produce an over pressure environment within the protective enclosure so that a positive flow of filtered air is maintained between the interior of the suit or enclosure and the outside environment, thus assuring that no contaminants may seep into the protected, contaminant free interior. The protective enclosures protect individuals from contact with and inhalation of noxious chemicals, inorganic and organic dust and particles, as well as radioactive particles that would ordinarily be associated with industrial emergencies and/or an intentional terrorist attack.

15 Claims, 6 Drawing Sheets

U.S. PATENT DOCUMENTS 6,543,450 B1 4/2003 Flynn
6,701,919 B1 3/2004 Silver et al.
6,715,160 B2 4/2004 Crye et al.
6,752,146 B1 6/2004 Altshuler et al.
6,945,064 B2 * 9/2005 Jebaraj ..... 62/259.1
2003/0088780 A1 5/2003 Kuo et al.
2003/0192103 A1 10/2003 Avery et al.
2003/0192537 A1 10/2003 Odell et al.

* cited by examiner

INFLATABLE PROTECTIVE ENCLOSURE

BACKGROUND OF THE INVENTION

1. Field of Invention

The present invention pertains to emergency enclosures and garments. In particular, the present invention pertains to inflatable enclosures that provide a contaminant free environment for one or more individuals.

2. Description of Related Art

Protective suits and protective enclosures have traditionally been designed to meet the extreme needs of military, police and emergency response personnel. Such suits/enclosures are typically designed for prolonged use by individuals performing assigned missions within dangerous and/or contaminated environments and/or under extreme conditions.

Such suits are typically designed of durable materials that resist tearing under stressful use under extreme conditions (e.g. heat, cold, wet, ice snow) and are typically designed for use with masks, hats, gloves, and/or complex breathing apparatus. For example, protective suits for firefighters are typically made of thick insulated, flame resistant material and often contain a breathing apparatus and/or filters that are integrated within the suit. Suits for biohazard response teams are typically designed for active use moving within and cleaning up contaminated areas (e.g., setting up barriers, moving and operating cleanup equipment).

Protective enclosures have also typically been designed for extreme conditions. For example, emergency protective enclosures for fire-fighters are designed using materials that insulate an occupant against extreme heat within hostile environments. Protective enclosures for military personnel are typically self-standing and are typically designed with sufficient strength to support an ongoing military mission in an exposed outdoor environment. As a result, such structures are heavy and cumbersome. Further, conventional protective enclosures typically have pump and/or filters positioned outside of the protective enclosure. This forces an individual to leave the protected area in order to operate or service the pump and/or filters, thereby risking exposure to contamination.

Cost has typically not been a factor in the design of such traditional protective suits and enclosures. Such suits and enclosures have typically been made for use in limited quantities to meet the needs of specific groups financed by Federal, state and/or local governments budgets. As a result, such suits and enclosures are typically not available to and/or are outside the budget and/or either exceed or otherwise do not meet the needs of the general civilian population. For these reasons, very few members of the civilian population have access to any form of protective suit or enclosure that is capable of temporarily protecting them from a contaminated environment. Still fewer would have sufficiently timely access to a protective suit or enclosure during a time of emergency to assure protection against contamination.

Unfortunately, due to relatively recent changes in technology and national/world events, the risk of accidents and/or attacks that would lead to the harmful or even deadly exposure of large civilian populations to contamination by harmful or even deadly substances is ever increasing. For example, accidental and/or intentional train derailments, tractor-trailer accidents, chemical/processing plant accidents, chemical and fuel storage depot explosions, nuclear power-plant accidents, etc., could result in catastrophe for thousands of individuals unless they have access to either a protective suit or enclosure capable of protecting them during a temporary and/or long term period of living in a contaminated environment. Further, the constant threat of a direct terrorist biological and/or biochemical attack, explosion of a radioactive dirty-bomb in an urban business sector, explosion of a small scale nuclear device, and/or sabotage of even a small operational nuclear power plant could result is the release of clouds of dust and radioactive fallout that would endanger thousands of civilians living and/or working within the proximate area or downwind of the location of attack.

Fortunately, the detrimental impact of any of these scenarios can be greatly diminished by providing civilians with even minimal protection. For example, most conventional contaminants are either inhaled or absorbed through the skin. Even most radio-active fallout will only result in nominal damage so long as radio-active dust and/or other particles are not inhaled into the lungs and/or an individual is not subjected to long term external contact with radio-particles that typically settle upon the body within a contaminated environment in the form of dust and/or rain and are subsequently absorbed via the skin, eyes, nose and mouth into the body and/or allowed to settle on food that is later ingested. Therefore, by providing civilians with nominal external protection, an air supply filtered of organic and/or inorganic particulate matter and/or noxious gases, and safe access to clean food and water sources, the damage to civilian populations caused by such individual accidents and/or attacks may be greatly diminished.

SUMMARY OF THE INVENTION

Hence, a need remains for a method and apparatus for providing a temporary, contaminant free environment for one or more individuals. Preferably, the approach would provide a protective suit and/or enclosure that is inexpensive, compactly stored and light-weight, yet provide upper-body and or full-body protection for one or more persons. The protective suit or enclosure would preferably be water and gas impermeable and would provide the user with the ability to bring clean, filtered air from the outside environment into the suit or enclosure. Further, the protective suit or enclosure would preferably allow the user to establish an over-pressure environment within the enclosure so that a positive flow of filtered air is maintained from the interior of the suit or enclosure to the outside environment, thus assuring that no contaminants seep into the protected, contaminant free interior.

In accordance with the present invention, an apparatus for providing a protective contaminant-free enclosure for one or more individuals and methods of producing said apparatus are described.

In a first exemplary embodiment of the invention, an inflatable, pressurized emergency personal protective enclosure, or suit, is described. The embodiment provides a user with the ability to move within a contaminated environment and/or to optionally interact with objects within the contaminated environment. The structure may be inflated and pressurized with an air pump and filter (e.g., HEPA, activated charcoal, etc.) that is contained within and operated by the user within the protected region of the protective enclosure.

The pump and filters may be positioned within the protected environment, thereby allowing an individual within the protected environment to operate and/or service the pump (e.g., change batteries, swap filters, etc.) without risking contamination. Preferably the pump is positioned to bring fresh incoming air to a region within the protective enclosure that is as close to the user's head and face as possible, in order to maximize the occupant's inhalation of fresh air. The protective enclosure may be configured with appropriate detectors for monitoring the interior (e.g., $CO_2$ detectors) and/or exterior environment (e.g., poison gas and/or radiation detectors).

Preferably detectors are configured to monitor the level of one or more predetermined gases at several locations within the protective enclosure. Such detectors may automatically activate the pump/filter and/or activate alarms based upon determined readings. Further, safety information may be printed on the inside of the enclosure for the occupant to read such as standard emergency guidance/instructions and/or emergency phone numbers in case the person has a cell phone.

The pump provides a source of filtered, contaminant free air that is used to establish a positive air pressure within the structure. In this manner any leaks in the protective membrane result in an outward flow of filtered air from the interior of the enclosure to the exterior of the enclosure rather than an inward seepage of contaminated air. The air pump, or bellows, may be powered by A/C utility power, D/C battery power, and/or manually operated. The structure is preferably constructed of light weight plastic, rubber or some other flexible material that is completely clear, or clear in some areas in order to allow the occupants to see outside. The embodiments described are stowable within articles of clothing such as belts or collars or easily stowed within a briefcase, knapsack, suitcase, pocket, glove compartment, purse, drawer, etc.

In a second exemplary embodiment of the invention, an inflatable, pressurized emergency protective enclosure or living space for one or more individuals is described. The invention is similar to the personal protective enclosure embodiment described above, but the present embodiment is larger and configured to provide an inflatable, pressurized emergency personal protective enclosure capable of protecting one or more occupants. For example, a single person embodiment may be configured as a 3×3×7 rectangular inflatable enclosure suitable for a single occupant to stand or lay down. In an embodiment configured to allow the occupant to stand, the manual bellows may be manually operated by a simulated walking motion. The enclosure may be configured with vents that allow accumulated gas and/or smoke to be vented from the top and/or bottom of the enclosure, respectively. The structure is preferably constructed of light weight plastic, rubber or some other flexible material that is completely clear, or clear in some areas in order to allow the occupants to see outside. The protective enclosure may be configured with appropriate detectors for monitoring the interior (e.g., $CO_2$ detectors) and/or exterior environment (e.g., poison gas and/or radiation detectors). Such detectors may automatically activate the pump/filter and/or activate alarms based upon determined readings.

In addition to the embodiments described above, disclosed are embodiments of key components that allow an individual to tailor the exemplary first and second embodiments described above to meet their specific needs. For example, the described components allow a group, or individual, to construct an emergency protective over-pressure suit or protective enclosure of any size and shape tailored to meet specific needs. These novel components allow an individual to build single or multi-person enclosures that may include specific features that an individual believes he and/or his loved ones will need to safely sit out a period of emergency. Such components for suits may include ports for safely receiving food and drink and/or ports for allowing disposal of waste products. Such components for enclosures may include air-tight seams, air-tight hatches, air purification intake ports, over-pressure exhaust outlet valves and any number of optional features such as air-tight power line input ports, airtight interior/exterior relative pressure monitors, secondary structural supports, air-tight exterior access arms and access to exterior water supplies, exterior restroom facilities, etc.

The above features and advantages of the present invention will become apparent upon consideration of the following descriptions and descriptive figures of specific exemplary embodiments thereof. While these descriptions go into specific details of the invention, it should be understood that variations may and do exist and would be apparent to those skilled in the art based on the descriptions herein.

DETAILED DESCRIPTION OF PREFERRED EMBODIMENTS

Figure 1:
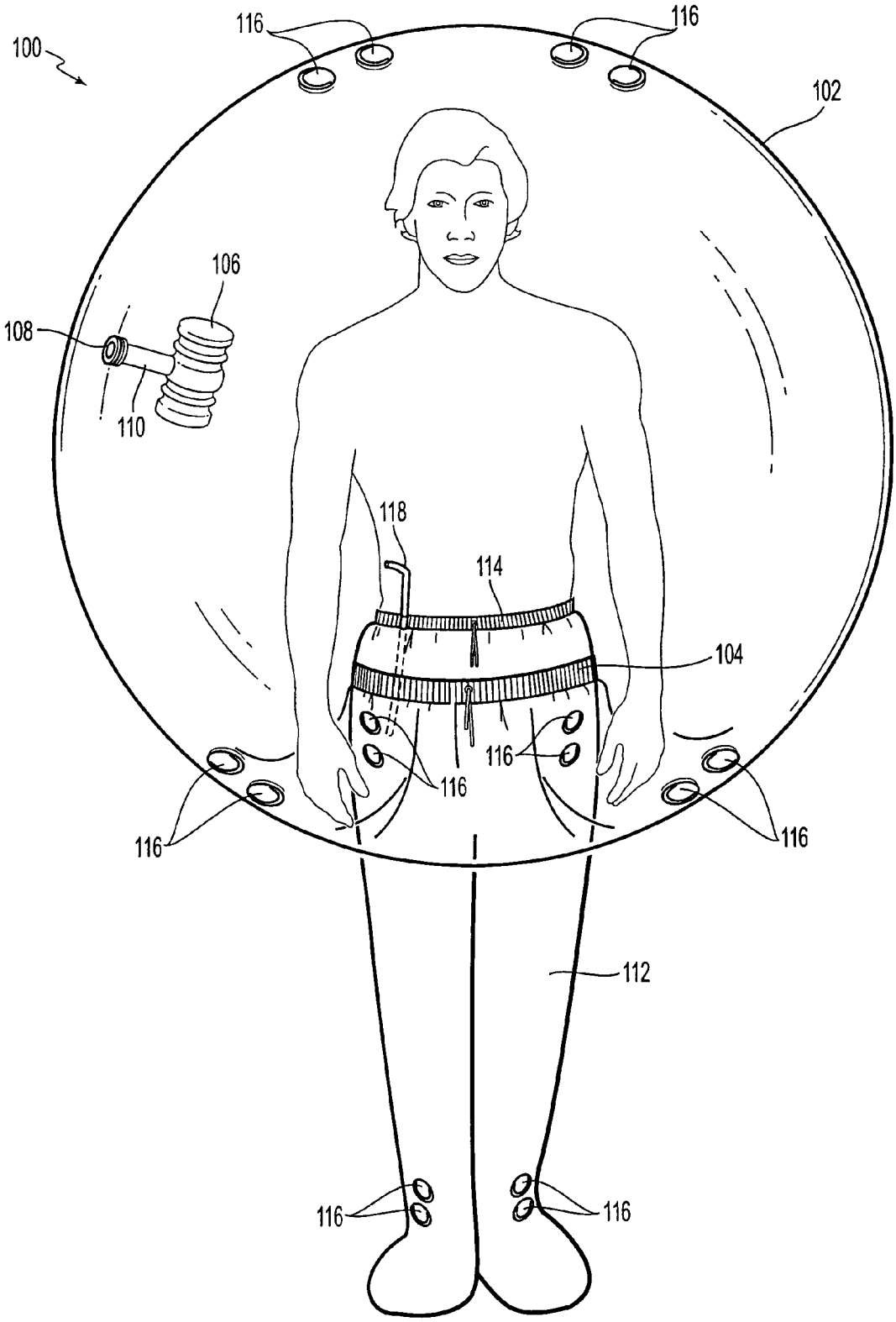
FIG. 1 is a perspective view of an exemplary first embodiment of an inflatable, over-pressure protective enclosure designed for use by a single individual in accordance with an exemplary embodiment of the present invention.

Exemplary embodiments according to the present invention are described below with reference to the above drawings, in which like reference numerals designate like components.

FIG. 1 is a perspective view of an exemplary first embodiment of an inflatable, over-pressure protective enclosure 100 designed for use by a single individual. As shown in FIG. 1, the exemplary embodiment includes a water and gas impermeable upper torso membrane 102 that may be draped over an individual's upper torso and cinched tight at the waist by use of a draw string, or elastic band, 104. Alternatively, the membrane may be a large bag-like container with an opening through which the individual climbs, as described below with respect to FIG. 2. A resealable structure allows the individual to close and seal the opening.

An individual, or occupant, within protective enclosure 100 may inflate the structure with purified/filtered air via a manual/electric pump, or bellows, 106. Pump 106 may be attached to upper torso membrane 102 and draw air through a reinforced inlet port 108 and intake hose 110, as shown in FIG. 1. Alternatively, air may be drawn from outside of upper torso membrane 102 through intake hose 110 by positioning intake hose 110 so that intake hose 110 traverses from the interior of upper torso membrane 102 to the exterior of upper torso membrane 102 between the user's torso and drawstring/elastic band 104. Further, as shown in FIG. 1, the embodiment may include a protective lower torso membrane 112 that encloses the occupant's lower torso and legs converging at a draw string, or elastic band, 114. In such a configuration, an occupant would preferably, encompass draw string, or elastic band, 114 within the protective environment formed by membrane 102. The embodiment depicted in FIG. 1 allows the occupant to remain mobile with optional increased lower body protection.

By inflating the interior of upper torso membrane 102 to a pressure equal to or greater than the pressure outside of upper torso membrane 102, the membrane forms a protective environment of filtered air about the upper torso of the occupant within which the occupant my comfortably move and breath. By continuing to operate pump 106, fresh purified air is continually brought into the interior of membrane 102. Gases within the interior are returned to the exterior environment via a positive-pressure air-flow that allows air within the interior of protective enclosure 100 to return the outside environment via the cinched waist-line 104, and a series of one-way valves incorporated into membrane 102. Exhaust valves 116 located near the top of membrane 102 vent lighter gasses that tend to rise to the top of protective enclosure 100. Heavier gasses such as exhaled carbon dioxide tend to settle to the bottom of protective enclosure 100 and are vented through one-way exhaust valves 116 located in lower portion of the protected environment, closer to draw string/elastic band 104. In this manner, the pressure within the protective enclosure provided by the pump may be released through the membrane via one-way valves incorporated into membrane 102. This release of pressure has the natural tendency to pressure out noxious heavy gases via the lower exhaust valves and to pressure out noxious light gases via the upper exhaust valves, thereby assuring that fresh air is provided to the occupant.

In an optional embodiment, a flexible yet non-collapsible pressure sharing tube 118 may connect the protected environment formed by upper torso membrane 102 with the protected environment formed by lower torso membrane 112, thereby allowing filtered air to flow under pressure from the protected area formed by membrane 102 to the protected area formed by lower torso membrane 112. In such an embodiment, lower torso membrane 112 may also be fitted with one or more exhaust valves 116 to release pressure, should the interior lower torso pressure exceed a predetermined level (e.g., upon sitting down with a fully inflated lower torso membrane, etc.). By venting air via exhaust vents 116, moisture from perspiration and the user's exhaled breath is also removed from the interior of the protective enclosure, thereby allowing the protected interior to remain more comfortable.

Upper torso membrane 102 and lower torso membrane 114 may be constructed to form any shape when inflated. The membranes may include any number of specially shaped portions, or segments, which are then connected together along one or more seams to form the final membrane. Seams may be fashioned in any manner, such as using adhesives, thermal sealing, stitching, and/or any combination of techniques may be used to achieve strong seams that resist leaking and bursting when the membrane is pressurized.

Upper torso membrane 102 may be formed, as shown in FIG. 1, with a large enclosed space about the user, or may be tailored to conform more closely to an individual's torso. Preferably the upper torso membrane 102 would provide a user with sufficient interior space to hold and operate pump 106 within the protective enclosure. Further, both upper torso membranes and lower torso membranes may be sized sufficiently large so as to accommodate any sized individual. As described with respect to FIG. 1, the nature of upper torso membrane 102 and lower torso membrane 112 easily accommodate a one size fits all approach.

Optionally, upper torso membrane 102 may include optional arm extensions that allow a user to extend his arms and hands beyond a perimeter of upper torso membrane 102 to manipulate objects outside of the protective enclosure. When not in use, such arm extensions may be inverted and pulled into the interior of the protective enclosure, thereby deflating the extension. The deflated extension may then be tucked into a protective pocket attached to the inside or outside of upper torso membrane 102. Further, the embodiment depicted in FIG. 1 may be tailored by a user with additional optional features in order to meet the user's individual needs, as described in greater detail below.

Figure 2:
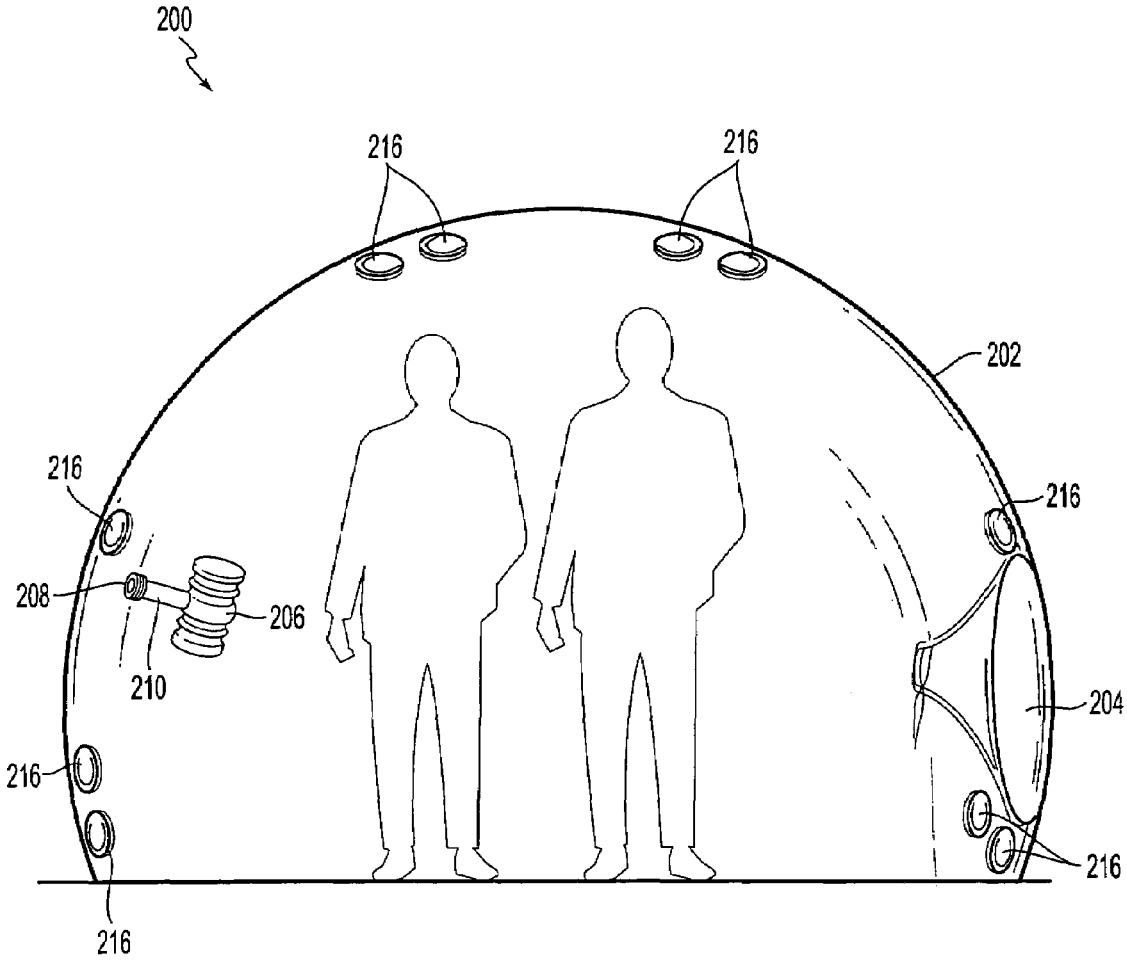
FIG. 2 is a perspective view of an exemplary second embodiment of an inflatable, over-pressure protective environment designed for use by one or more individuals in accordance with an exemplary embodiment of the present invention.

FIG. 2 is a perspective view of an exemplary second embodiment of an inflatable, over-pressure protective environment designed for use by one or more individuals. The embodiment presented in FIG. 2 provides a full-body over-pressure protected environment 200 in which one or more individuals may reside in comfort despite contamination of the environment outside of protected environment 200.

The embodiment presented in FIG. 2 is similar in use and features to the embodiment presented in FIG. 1. As shown in FIG. 2, the second exemplary embodiment includes a water and gas impermeable membrane 202 that fully encloses one or more occupants. The membrane may be securely cinched tight and sealed using an air-tight, resealable closing mechanism 204 (e.g., a draw string, an elastic band, plastic zipper seal, etc.) to close off the entrance to the interior of membrane 202. Once inside, the occupant or occupants within protective enclosure 200 may inflate the structure with purified/filtered air via manual/electric pump, or bellows, 206. Pump 106 may be attached to membrane 202 and draw air through a reinforced inlet port 108 and intake hose 110, as shown in FIG. 2. The exemplary embodiment depicted in FIG. 2 provides greater comfort and full body protection for the occupant or occupants than the exemplary embodiment depicted in FIG. 1, but does not provide mobility.

By inflating the interior of membrane 202 to a pressure equal to or greater than the pressure outside membrane 202, the membrane forms a protective environment of filtered air about the occupant(s) within which the occupant(s) may comfortably move and breath. By continuing to operate pump(s) 206, fresh purified air is continually brought into the interior of membrane 202. Gases within the interior are returned via a positive-pressure air-flow that allows air within the interior of protective enclosure 200 to return the outside environment via a series of one-way exhaust valves 216 incorporated into membrane 202. Exhaust valves 216 located near the top of membrane 202 vent lighter gasses that tend to rise to the top of protective enclosure 200. Heavier gasses such as exhaled carbon dioxide tend to settle to the top of protective enclosure 200 and are vented through one-way exhaust valves 216 located in the lower portion of the protected environment, closer to a surface (e.g., the ground or floor) upon which the enclosure rests.

The embodiment presented in FIGS. 1 and 2 are intended to be uncomplicated in function and use, yet provide effective protection. The invention allows the protective enclosures to be stored in small packages, so that one or more protective enclosures are likely to be available when needed. By supporting manual operation, the invention may be stored for long periods of time, yet remain fully operational when needed. The uncomplicated nature of the invention allows the protective enclosures to be produced at low cost, thereby further increasing the availability of one or more of the enclosures to each and every member of the general public.

The invention provides a further advantage in that it allows an able bodied individual to care for an individual that would not be able to effectively assisted using a traditional protective suit and/or gas mask. For example, embodiments shown in FIG. 1 and FIG. 2 would allow a nursing mother to protect and continue to nurse, provide food and otherwise care and comfort her hungry and or crying child. Traditional protective suits with gas masks do not accommodate such needs. Further, the embodiment depicted in FIG. 2 would allow children of all ages, as well as the elderly, to be quickly and easily protected by those who are more able bodied. Traditionally, protective gear such as suits and gas masks are expensive and do not fit well to small children. It is often difficult to supervise children so that they do not remove their protective gear when they become uncomfortable. Further, as children grow, they typically outgrow their protective suits and masks, resulting in an inadequate fit. The exemplary embodiments described above avoid such difficulties.

The thickness of the membrane 102 and 202 in the embodiment above may vary significantly. The thickness of membrane 102 may be determined by balancing the needs for puncture and tear resistance with the need for compact storage, weight and flexibility. For example, an embodiment designed for a single individual may typically use a thinner more flexible material than an embodiment designed for use by multiple persons due to an individual's ability to better control his activities while within the protective suit to avoid tears and punctures. Embodiments designed for multiple individuals and/or including children and/or infants may use a thicker material for improved durability. Clear polyurethane sheet with a thickness ranging from 0.25 mil to 6 mil should meet the needs of most embodiments, however, sheet material with a greater thickness may be used.

Optionally, membrane 202 may include optional arm extensions that allow a user to extend his arms and hands beyond a perimeter of membrane 202 to manipulate objects outside of the protective enclosure. When not in use, such arm extensions may be inverted and pulled into the interior of the protective enclosure, thereby deflating the extension. The deflated extension may then be tucked into a protective pocket attached to the inside or outside of membrane 202. Further, the embodiment depicted in FIG. 2 may be tailored by a user with additional optional features in order to meet the user's individual needs, as described in greater detail below.

By way of example, a membrane embodiment, as shown in FIG. 1, made of 0.25 mil plastic should fold to the size and weight of a typical small handkerchief, while the same embodiment made using 6 mil plastic should fold to the size and weight of a typical pair of lightweight shorts. By way of a second example, a membrane embodiment as shown in FIG. 2 sized for two persons made of 1 mil plastic should fold to the size and weight of a typical pair of lightweight pants, while the same embodiment made using 6 mil plastic should fold to the size and weight of a typical lightweight blanket. Of course, by carefully folding and/or storing in a vacuum sealed bag or container, the storage requirements of each of the exemplary embodiments may be minimized. For example, in one exemplary embodiment, the protective membrane and air filters may be folded and stored within the envelope of the manual pump or bellows used to achieve the purified-air overpressure environment within the protective membrane, as described below.

Figure 3:
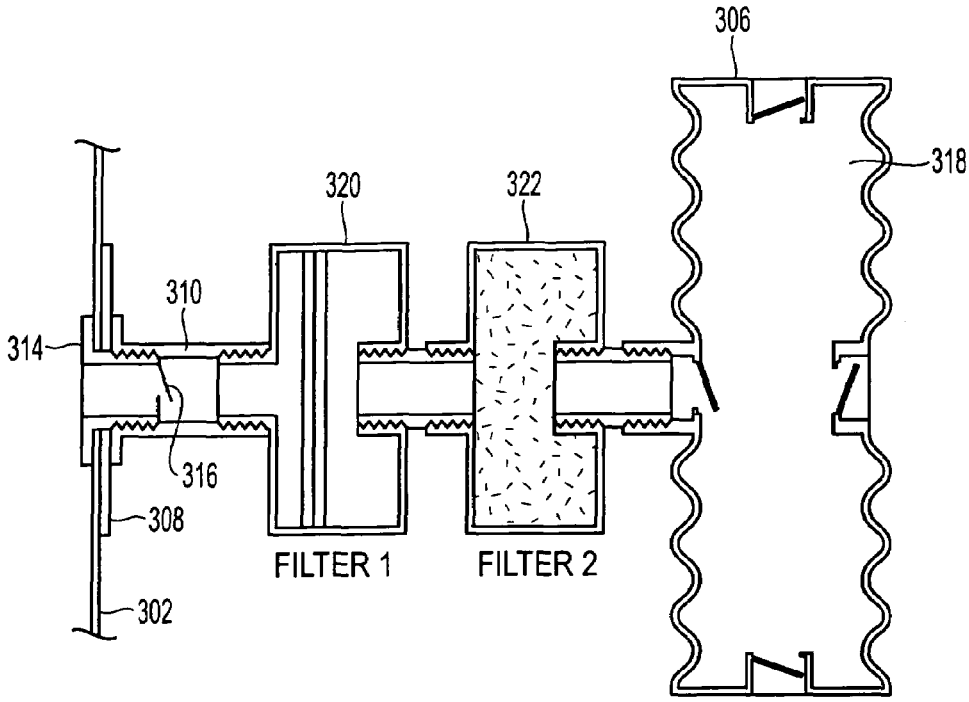
FIG. 3 is a cross-sectional view of an exemplary pump and filter configuration for use in association with the over-pressure protective enclosures, or suits, in accordance with an exemplary embodiment of the present invention.

FIG. 3 presents an exemplary pump and filter configuration that may be used in association with the present invention. Preferably, filters are inserted/attached in series to hose 310, prior to connection of pump 306. In this manner a less complicated (i.e., leaky) pump or bellows may be used, yet any air passing from the exterior to the interior of the membrane must pass through the in-line filter(s). Further, such an approach allows the use of any number of filters in series, to accommodate the nature of the contaminants that must be filtered. In addition, such an approach allows filters to be easily replaced once they have reached the end of their expected useful life. Still further, in the event that pump 306 fails, a single occupant may draw breath directly from the output of the last filter connected to hose 310 and maintain pressure within the protective enclosure by exhaling into the protective interior.

As shown in FIG. 3, hose 310 may attach to protective membrane 302 by threading tightly onto access port 314 inserted through a reinforced hole 308 in the membrane and thereby tightly sandwiching membrane 302 between hose 310 and threaded access port 314 to create an airtight connection. Alternatively, threaded access port 314 may be hermetically or adhesively affixed to membrane 302 in a manner that provides an air-tight connection. Preferably, access port 314 includes an interior one-way valve 316 that allows air to be drawn into the protective enclosure through valve 316, in response to a vacuum created by pump 306 that draws air into air-chamber 318, or in response to an individual inhaling on the outlet of the last filter attached to hose 310.

As further shown in FIG. 3, filters may be attached in series to hose 310 to achieve the level of filtering required. For example, FIG. 3 depicts the use of a HEPA filter 320 to remove particles in series with a charcoal filter 322 to remove noxious gases. Once the filters are in place, any form of pump/bellows or a simple mouth respirator may be attached to the outlet of the last filter attached to the end of hose 310. Further, in case of a pump failure an occupant may inhale directly from the filtered end of hose 310, or attach a simple mouthpiece, or respirator, for increased comfort. In FIG. 3, a simple bellows is shown.

Figure 4:
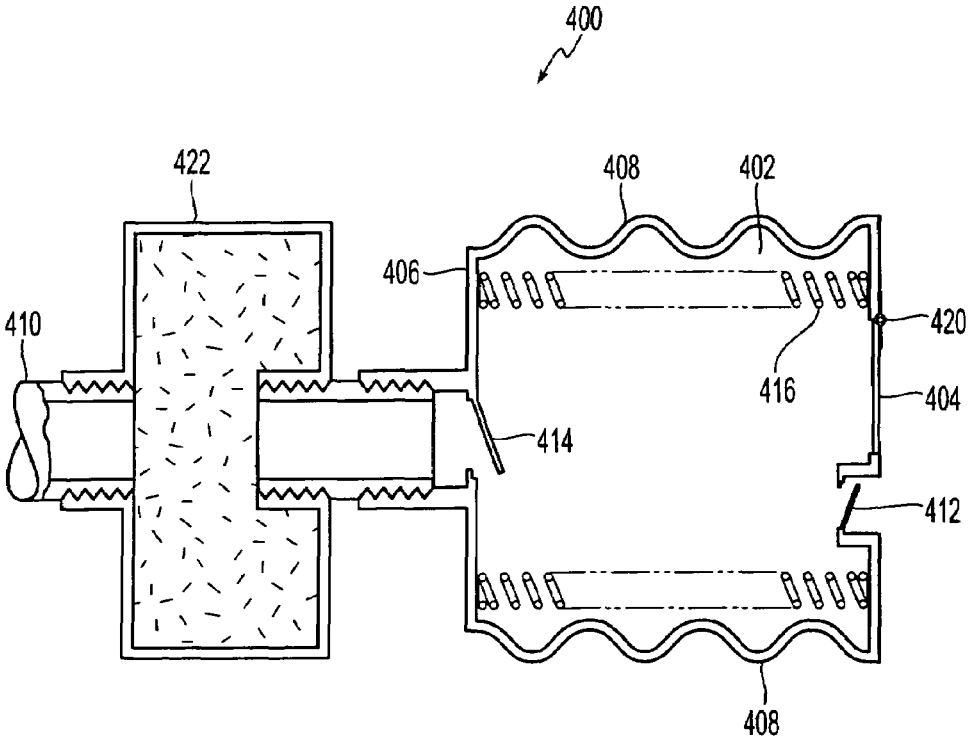
FIG. 4 is a cross-sectional view of an exemplary pump, or bellows, for use in association with the over-pressure protective enclosures, or suits, in accordance with an exemplary embodiment of the present invention.

FIG. 4 presents a representative pump, or bellows, that may be used to establish a purified air over-pressure environment within a protective enclosure in accordance with an exemplary embodiment of the present invention. Such pumps are preferably high volume, low-pressure pumps capable of achieving a pressure within the interior of the protective membrane only slightly greater than the outside environment. For example, pumps capable of achieving too high an internal pressure may result in inadvertent ruptures of relatively delicate membrane seams.

As shown in FIG. 4, pump or bellows 400 may include an air chamber 402 with a relatively stiff upper surface 404, a relatively stiff lower surface 406 and collapsible sides 408. Stiff upper surface 404 may include a one-way exhaust valve 412 that allows air to leave air chamber 402 and enter the interior of the protective enclosure upon compression of the bellows, yet closes upon expansion of the bellows so that new air is drawn from the exterior of the protective enclosure, through the filters and into air chamber 402. A one-way input valve 414 may connect to the last filter 416 connected to input hose 410 and allow air to enter air chamber 402 upon expansion of air chamber 402 yet close upon compression of air chamber 402, so that clean, filtered air within air chamber 402 is expelled into the interior of the protective enclosure through one-way exhaust valve 412, as described above. A spring or elastic material 418 internal to air chamber 402 may be compressed (thereby storing mechanical energy) upon release of the bellows by a user spring or elastic material 418 may then expand to its original uncompressed shape thereby creating a vacuum and drawing air from the outside environment, through the filters and hose 410 and into the interior of air chamber 402. Alternatively, a user may manually operate both the compression and the expansion of bellows 400, thereby negating the need for spring/elastic material 418

Assuming that the intake port connection between the hose 410 and the membrane material includes a valve that allows air to enter but not exit hose 410, as described above with respect to FIGS. 1 and 2, one-way input valve 414 may not be required. However, one-use of one-way input valve 414 is preferred to increase the efficiency of pump/bellows 400, depending upon the length and compressible internal volume of hose 410.

In one exemplary embodiment, stiff upper surface of bellows 400 may include a hinge 420 that allows air chamber 402 to be temporarily opened to allow access to the interior of air chamber 402. Such an embodiment allows the protective membrane, hose and filters to be stowed within air chamber 402. The air chamber 402 may then be compressed and sealed within an airtight bag in order to retain the small condensed profile.

The embodiments described, above, with respect to FIGS. 1-4 are temporary emergency enclosures. For example, an employee in downtown Washington, D.C. upon learning that a dirty-bomb containing radio-active debris has been exploded nearby could enter a protective enclosure as shown in FIG. 1 in order to minimize his exposure while evacuating the city. Alternatively, if workers are instructed to stay put due to high levels of surrounding contamination, one or more individuals could enter an embodiment as described with respect to FIG. 1 or FIG. 2 and safely wait for the threat of contamination to pass.

Although such protective environments embodiments provide short term emergency protection against a contaminated, or soon to be contaminated, environment, they do not provide a complete solution for dealing with longer term or extended periods of threat. Typically, the period during which the risk of contamination is imminent is longer than the duration of the of the contamination, assuming that actual contamination even occurs. For example, during a period of war (e.g., Israel during the first and second Gulf Wars) the period during which a threat of chemical and/or biological attack may remain eminent may last days or even weeks. Preferably, a family would be able to safely wait out such a period of threat without loosing access to all the daily necessities and amenities of life.

One focus of the present invention is to make effective protection against contamination "available" to the general public. In order to be "available," exemplary embodiments of the present invention would preferably be affordable and effective. Given the different needs and resources of different members and/or groups of the general population, an embodiment intended to address a longer term period of threat and/or a long term period of contamination would preferably be configurable to meet individual and group needs.

For example, FIG. 5 through FIG. 11 depict representative components that may be used to tailor any or all of the embodiment described above, and or to construct a new protective enclosure tailored to meet the longer term needs of an individual or group.

Figure 5A:
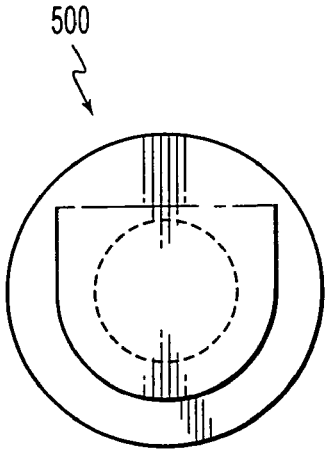
FIGS. 5A and 5B present a plan view and a cross-sectional view, respectively, of an exhaust valve in accordance with an exemplary embodiment of the present invention.
Figure 5B:
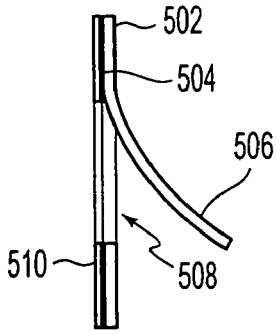

FIGS. 5A and 5B present an exemplary auxiliary exhaust valve 500 that may be added to the upper or lower regions of the protective enclosure to improve the expulsion of undesirable gases, as described above, and/or to improve overall circulation. As depicted, in FIG. 5B, exhaust valve 500 may include a collar 502, with adhesive coating 504 on a back surface of collar 502 used to adhere collar 502 to the exterior surface of a protective enclosure membrane. Adhesive coating 504 is preferably shielded prior to installation by a protective backing 510. Exhaust valve 502 further includes a flapper valve 506 that covers and seals an exhaust port 508, unless the pressure on the interior of the protective enclosure membrane is above a predetermined pressure greater than the pressure of the external environment. As depicted in FIG. 5B, exhaust valve 502 may be attached to a protective enclosure membrane by removing protective backing 510 from adhesive coating 504 and pressing collar 502 against the membrane in a desired location. A hole in the protective enclosure membrane may then be cut corresponding to exhaust port 508. Inclusion of additional exhaust valves protects against over-pressure ruptures of protective enclosure seams due to excessive pressure levels within the interior of the protective enclosure. Such excessive pressure levels may be easily produced by electric pumping devices which are not pressure controlled and/or are not adequately monitored.

Figure 6:
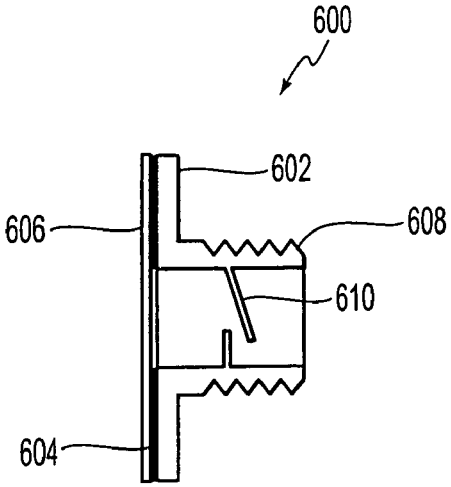
FIG. 6 is a cross-sectional view of an air intake access port in accordance with an exemplary embodiment of the present invention.

FIG. 6 presents an auxiliary air intake access port 600, as described above in FIG. 3 at 314, with an adhesive backing. Such an auxiliary air input may be added to the side of a protective enclosure so that additional filter hoses (FIG. 3 at 310) may be securely attached. Such a feature allows the number of pumps supported by a single protective enclosure to be modularly expanded. As depicted in FIG. 6, access port 600 may include a collar 602, with adhesive coating 604 on a back surface of collar 602 used to adhere collar 602 to the interior surface of a protective enclosure membrane. Adhesive coating 604 is preferably shielded prior to installation by a protective backing 606. Access port 600 may further include a threaded nozzle 608 with an internal valve 610 that allows air to flow towards the interior of the protected environment in response to a vacuum, as described above. As depicted in FIG. 6, access port 600 may be attached to a protective enclosure membrane by removing protective backing 606 from adhesive coating 604 and pressing collar 602 against the membrane in a desired location. A hole in the protective enclosure membrane may then be cut corresponding to the interior diameter of threaded nozzle 608. Inclusion of additional access ports allows flexibility with respect to the addition of additional pumps and/or allows spent filters that may not be safely removed to remain in place, despite rendering useless the access port to which the spent filter is attached.

Figure 7:
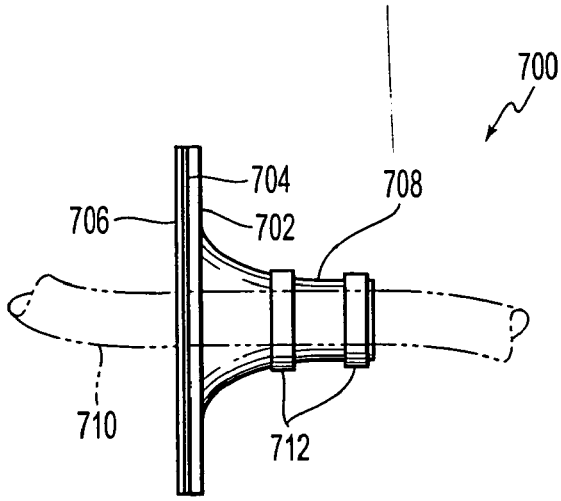
FIG. 7 is a cross-sectional view of an electrical cord access port in accordance with an exemplary embodiment of the present invention.

FIG. 7 presents an auxiliary electrical cord access port 700. An electrical cord access port 700 allows an extension cord to safely penetrate the protective enclosure, thereby allowing electrical power from a ordinary wall socket, generator or battery into the protective enclosure for use in operating pumps, and other devices. As depicted, in FIG. 7, electrical cord access port 700 may include a collar 702, with adhesive coating 704 on a back surface of collar 702 used to adhere collar 702 to the interior surface of a protective enclosure membrane. Adhesive coating 704 is preferably shielded prior to installation by a protective backing 706. Electrical cord access port 700 may include an extended, tapered collar 708 that fits tightly against an extension cord 710 drawn through tapered collar 708 to thereby span the protective enclosure membrane. Electrical cord access port 700 may further include one or more clamps, or ties, 712 that further secure tapered collar 708 to the exterior of the electrical cord passing through.

Figure 8A:
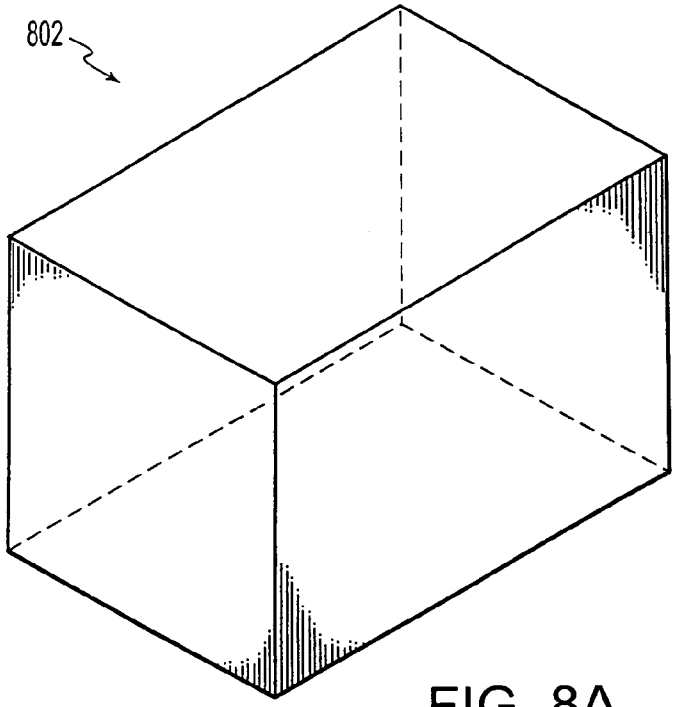
FIGS. 8A and 8B present perspective views of two exemplary protective enclosure module embodiments in accordance with an exemplary embodiment of the present invention.
Figure 8B:
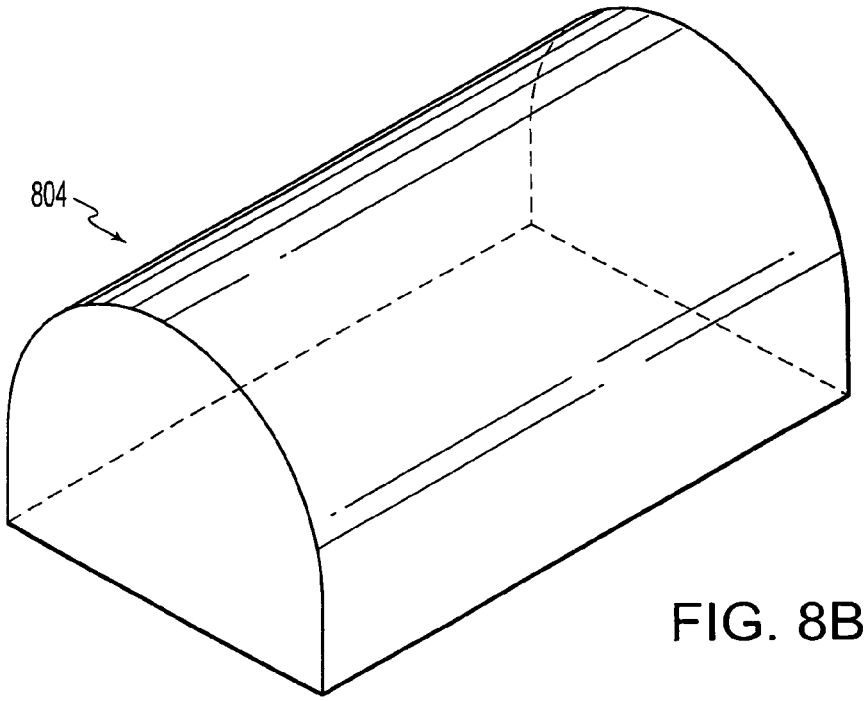

FIGS. 8A and 8B present two additional exemplary embodiments (802 and 804) of the protective enclosure described above with respect to FIG. 2. Although not depicted in FIG. 8, the embodiment shown may include all of the features included in the embodiment described with respect to FIG. 2. By mass-producing such modules, the general public is provided with an effective yet inexpensive protective enclosure that may be adapted to meet their respective requirements with any number of the additional features described with respect to FIGS. 5-11. Preferable, the exemplary embodiment would be made available in several standard sizes, and connect the protective environments together, as described below in a manner that matches the floor plan available in areas of interior rooms of the home or other building in which the protective enclosures are installed.

Figure 9:
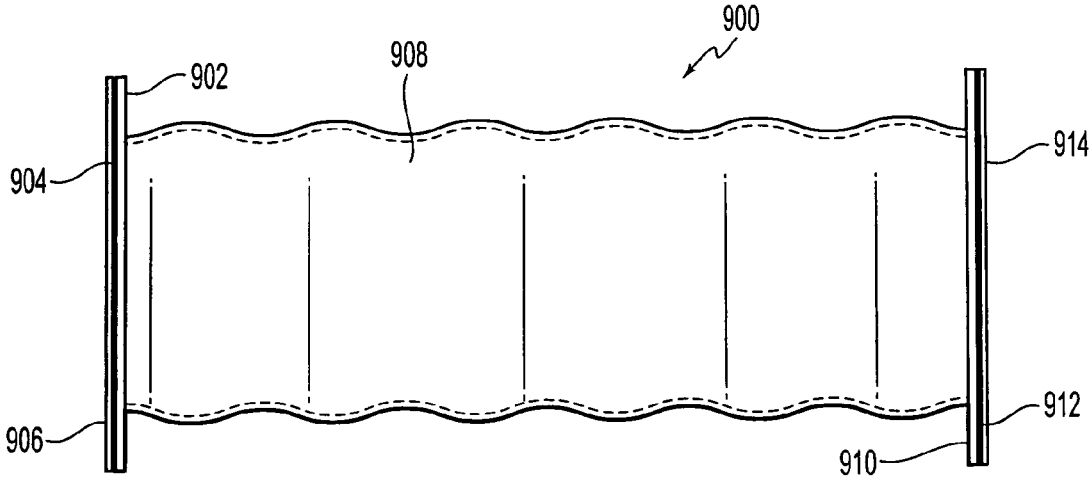
FIG. 9 is a cross-sectional view of a passageway used to connect two protective enclosure modules in accordance with an exemplary embodiment of the present invention.

FIG. 9 presents a passageway 900 that may be used to connect two protective enclosures, such as those depicted in FIG. 8. As depicted, in FIG. 9, passageway 900 may include a first collar 902, with a first adhesive coating 904 on a back surface of first collar 902 used to adhere first collar 902 to the exterior surface of a protective enclosure membrane. Adhesive coating 904 is preferably shielded prior to installation by a protective backing 906. Passageway 900 may further include a collapsible corridor 908 that terminates in a second collar 910 with second adhesive coating 912 and a second protective backing 914. As depicted in FIG. 9, passageway 900 may be attached between two protective enclosure membranes by removing protective backing 906 from first adhesive coating 904 and pressing first collar 902 against the exterior of a first protective enclosure membrane in a desired location. A hole in the protective enclosure membrane may then be cut corresponding to the interior diameter of collapsible corridor 908. Next, the protective backing 914 is removed from second adhesive coating 912 and second collar 910 is pressed against the exterior of a second protective enclosure membrane in a desired location. A hole in the second protective enclosure membrane may then be cut corresponding to the interior diameter of collapsible corridor 908. In this manner, any number of protective enclosures may be quickly connected to form a comfortable protective enclosure suitable for enduring an extended period of threat, as described above.

Figure 10:
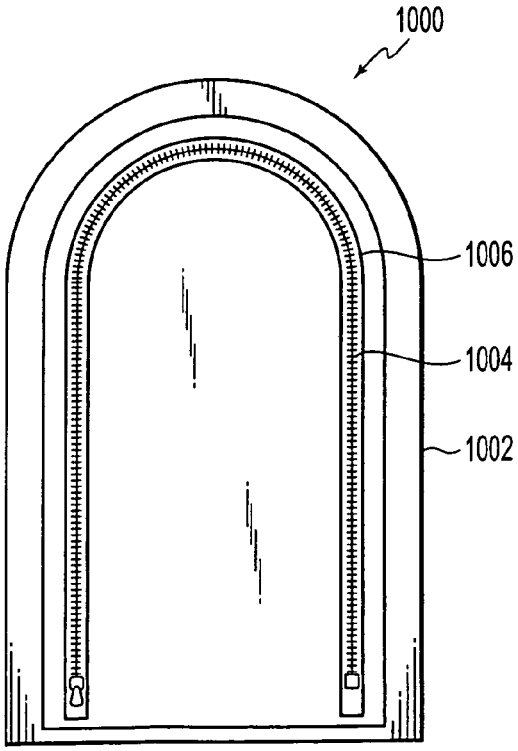
FIG. 10 is a plan view of a sealable entrance in accordance with an exemplary embodiment of the present invention.

FIG. 10 presents a sealable entrance 1000 that may be adhesively affixed to the exterior of a protective membrane to serve as an entrance/exit to the protective enclosure or as a sealable airlock between protective enclosure compartments and/or between a protective enclosure and a collapsible corridor, as described above. As depicted, in FIG. 10, sealable entrance 1000 may include a collar 1002, with a adhesive coating (not shown) on a back surface of collar 1002 used to adhere collar 1002 to the interior surface of a protective enclosure membrane. Adhesive coating 1004 is preferably shielded prior to installation by a protective backing (not shown). Sealable entrance 1000 may further include a reclosable zippered door 1004, the zipper of which may be further sealed, when closed with a resealable closure 1006 (e.g., zip-lock style closure, resealable/removable adhesive tape), thereby rendering zippered door 1004 substantially air-tight. As depicted in FIG. 10, sealable entrance 1000 may be attached to the interior of a protective enclosure membrane by removing the protective backing from the adhesive coating and pressing collar 1002 against the interior of a protective enclosure membrane in a desired location. A hole in the protective enclosure membrane may then be cut corresponding to the interior diameter of the opening exposed when reclosable zippered door 1004 in unzipped.

Figure 11:
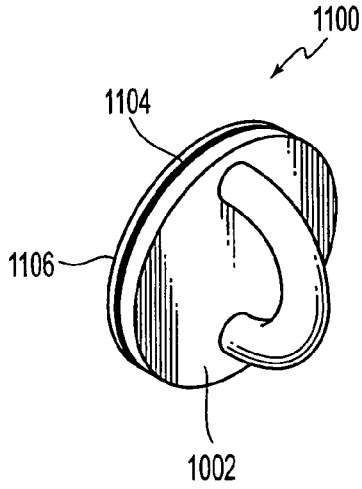
FIG. 11 is an exterior support loop in accordance with an exemplary embodiment of the present invention.

FIG. 11 presents and exterior support loop 1100 that provides reduced-stress external support of a protective enclosure membrane. Exterior support loop 1100 may include an adhesive patch 1102 with adhesive coating 1104 on a back surface of adhesive patch 1102 used to adhere adhesive patch 1102 to the exterior surface of a protective enclosure membrane. Adhesive coating 1104 is preferably shielded prior to installation by a protective backing 1106. Exterior support loop 1100 may further include an integrated loop 1108 that provides fasting point for a cord or other support for the top and/or side surfaces of the protective enclosure. Exterior support loop 1100 provides an safe external connection that may be used in conjunction with other exterior support loops 1100 positioned at other locations on the exterior of the protective enclosure to stabilized the enclosure with cords that provide tension support from the surrounding interior walls/ceilings of the room in which the protective enclosure is installed. Such supports allow pressure within a protective enclosure to drop below a level required to inflate the membrane without the interior of the protective enclosure collapsing.

It will be appreciated that the exemplary embodiments described above and illustrated in the drawings represent are only a few of the many ways of implementing and adapting an inflatable, protective enclosure for use by one or more individuals. The present invention is not limited to the specific embodiments disclosed herein, but may be applied to any inflatable, protective enclosure for use by one or more individuals.

The pump used to inflate an exemplary protective enclosure may use any type of pumping action, including but not limited to a piston style pump, a bellows style pump and or any type of mechanical or other air pumping device. Such an exemplary pump may be manually operated and/or mechanically or electrically powered. Electrically powered pumps may be powered using any voltage and/or current sustaining A/C or D/C power source.

An exemplary protective enclosure may be equipped with any type and number of pressure sensing gauges, monitors for determining the mixture and composition of gases within protective enclosure including the level of any and all life supporting gases and/or noxious gases and/or toxins. Such devices may issue audible or other alerts upon detecting a predetermined condition, such as a buildup of one or more gasses, and/or detection of one or more toxins either within or outside of the protective enclosure.

Pumps within an enclosure may be controlled based upon the results of one or more monitoring systems that monitor the mixture and composition of gases within protective enclosure including the level of any and all life supporting gases and/or noxious gases and/or toxins.

Filters used to filter incoming air may be configured in any manner. For example, filter materials may be integrated within an air pump and/or permanently affixed in any manner relative to the air pump. Further, one or more filter materials may be positioned before and/or after the pump relative to the flow of incoming air.

A pathway through which an air-pump receives external air may be connected to the external membrane of a protective enclosure in any manner, including but not limited to a hermetically sealed connection, a compression based connection, an adhesive seal, and/or any other manner by which a pathway may be established to draw air through the protective membrane without allowing contaminants to enter the protective enclosure.

A protective enclosure membrane may be constructed of any material and/or combination of materials that may result in a closed protective enclosure capable of maintaining a predetermined over-pressure relative to the atmospheric pressure external to the protective enclosure. Appropriate over-pressure levels may include any level of pressure greater than the atmospheric pressure immediately surrounding the enclosure that does not place the seams of the protective enclosure membrane at risk of rupturing. For example, in one representative embodiment the protective enclosure membrane and seams are configured to withstand an over-pressure as high as 1.5 times the surrounding atmospheric pressure. In another representative embodiment the protective enclosure membrane and seams may be configured to withstand an over-pressure of only 1.1 times the surrounding atmospheric pressure.

The capacity of a pump used in an embodiment of the present invention may be any pump capable of maintaining within the protective enclosure a predetermined over-pressure relative to the atmospheric pressure external to the protective enclosure. Appropriate over-pressure levels may include any level of pressure greater than the atmospheric pressure immediately surrounding the enclosure that does not place the seams of the protective enclosure membrane seams at risk of rupturing. For example, in one representative embodiment the protective enclosure membrane and seams are configured to withstand an over-pressure as high as 1.5 times the surrounding atmospheric pressure. In another representative embodiment the protective enclosure membrane and seams may be configured to withstand an over-pressure of only 1.1 times the surrounding atmospheric pressure.

Optional components/feature may be attached to the protective enclosure membrane in any manner including the use of adhesives, as described above, and/or the use of stitching, heat sealing, and/or use of any combination thereof to achieve an air-tight seal. If adhesives are used, the placement of the adhesives and/or the orientation of the respective collars relative to the interior and/or exterior of the protective enclosure membrane may be in any manner and/or orientation that results in an effective seal. Further, any additional structural and/or adhesive components may be used that facilitates achieving a strong structural bond and air-tight seam about the component added.

From the foregoing description it will be appreciated that the present invention includes novel approaches and methods for constructing and adapting an inflatable, protective enclosure for use by one or more individuals.

Having described exemplary embodiments of inflatable, protective enclosures for use by one or more individuals, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in their ordinary and accustomed manner only, unless expressly defined differently herein, and not for purposes of limitation.

What is claimed is:

1. An enclosure capable of protecting at least one individual from a contaminated environment, comprising:

a flexible gas and water impermeable membrane that defines an internal space enclosing at least a portion of the at least one individual, the impermeable membrane comprising a first impermeable membrane that encompasses a head, arms and an upper torso of the at least one individual, and a second impermeable membrane sealed to the first impermeable membrane portion that encompasses a lower torso of the at least one individual;

a pump, located entirely within the first impermeable membrane of the internal space, that draws a stream of external air into the internal space;

an inlet port associated with the first impermeable membrane and in communication with the pump for directing external air to the pump; and a filter, located entirely within the first impermeable membrane of the internal space and in communication with the pump and the inlet port, that filters the stream of external air prior to the stream of external air being released into the internal space;

wherein:

the pump is located within the internal space so as to be operable by the at least one individual within the internal space to inflate the internal space to establish a pressure in the first impermeable membrane and in the second impermeable membrane, based on the external air drawn into the internal space, that is greater than the surrounding atmosphere.

2. The enclosure of claim 1, wherein the filter is integrated within the pump.

3. The enclosure of claim 2, wherein the impermeable membrane is sealed to the inlet port of the pump.

4. The enclosure of claim 1, wherein the impermeable membrane has a thickness between 0.25 mil and 6 mil.

5. The enclosure of claim 1, wherein the impermeable membrane further comprises:

an extension through which the individual may extend an appendage beyond a perimeter of the impermeable membrane.

6. The enclosure of claim 1, wherein the impermeable membrane further comprises:

a pressure sharing tube that transfers air pressure from the interior space of the impermeable membrane to an interior space defined by another impermeable membrane.

7. The enclosure of claim 1, wherein the membrane includes a resealable opening for allowing the at least one individual to enter the enclosure and thereafter seal the opening.

8. The enclosure of claim 1, wherein the pump is at least one of manually operated, and electrically powered by a D/C power source.

9. The enclosure of claim 1, further comprising:

a gas monitor that monitors gases within the internal space to the enclosure.

10. The enclosure of claim 9, wherein the gas monitor monitors gases within the internal space at several predetermined locations within the enclosure.

11. The enclosure of claim 9, wherein the gas monitor presents a visual indication of a level of at least one predetermined gas internal to the enclosure.

12. The enclosure of claim 9, wherein the gas monitor initiates an alarm upon detecting a threshold level of at least one predetermined gas internal to the enclosure.

13. The enclosure of claim 9, further comprising:

a control module that controls operation of the pump in response to the gas monitor detecting a threshold level of at least one predetermined gas within the internal space.

14. The enclosure of claim 1, wherein the impermeable membrane further comprises:

a pressure sharing tubular structure attached to the walls of, and transferring air pressure between the internal spaces of, at least two impermeable membranes.

15. The enclosure of claim 1, wherein the first impermeable membrane is adapted such that the arms of the at least one individual are freely movable within the internal space.

* * * * *